US010775140B2

(12) United States Patent
Rastegar

(10) Patent No.: US 10,775,140 B2
(45) Date of Patent: Sep. 15, 2020

(54) CONTROLLED PAYLOAD RELEASE MECHANISM FOR MULTIPLE STACKS OF PYROPHORIC FOILS TO BE CONTAINED IN A SINGLE DECOY DEVICE CARTRIDGE

(71) Applicant: Omnitek Partners LLC, Ronkonkoma, NY (US)

(72) Inventor: Jahangir S Rastegar, Stony Brook, NY (US)

(73) Assignee: OMNITEK PARTNERS LLC, Ronkonkoma, NY (US)

( * ) Notice: Subject to any disclaimer, the term of this patent is extended or adjusted under 35 U.S.C. 154(b) by 0 days.

(21) Appl. No.: 16/403,581

(22) Filed: May 5, 2019

(65) Prior Publication Data

US 2019/0339049 A1 Nov. 7, 2019

Related U.S. Application Data

(60) Provisional application No. 62/668,193, filed on May 7, 2018.

(51) Int. Cl.

| | |
|---|---|
| ***F42B 4/02*** | (2006.01) |
| ***F42B 10/66*** | (2006.01) |
| ***F42B 4/26*** | (2006.01) |

(52) U.S. Cl.

CPC ..... *F42B 4/02* (2013.01); *F42B 4/26* (2013.01); *F42B 10/66* (2013.01)

(58) Field of Classification Search

CPC ..... F42B 4/26; F42B 4/24; F42B 4/02; B64D 1/00; B64D 7/00

See application file for complete search history.

(56) References Cited

U.S. PATENT DOCUMENTS

| | | | | |
|---|---|---|---|---|
| 6,055,909 | A * | 5/2000 | Sweeny | F41J 2/02 102/336 |
| 6,463,856 | B1 * | 10/2002 | Koch | F42B 5/15 102/247 |
| 9,067,844 | B2 * | 6/2015 | Lay | C06C 15/00 |
| 2012/0012605 | A1 * | 1/2012 | Melin | B64D 1/02 221/87 |

* cited by examiner

*Primary Examiner* — J. Woodrow Eldred

(57) ABSTRACT

A decoy device including: a cartridge casing; and two or more pyrophoric assemblies disposed longitudinally in the casing for sequential ejection from the casing, the two or more pyrophoric assemblies including: a pyrophoric material; a piston positioned rearward in an ejection direction relative to the pyrophoric material, the piston being movable in the ejection direction upon application of ejection force to eject the pyrophoric material from the casing; one or more energetic materials positioned rearward in an ejection direction relative to the piston, the one or more energetic materials being initiated by electrical impulse to provide the ejection force to the piston; and an inert barrier layer positioned rearward in an ejection direction relative to the impulse cartridge.

9 Claims, 6 Drawing Sheets

FIG. 6a
FIG. 6b
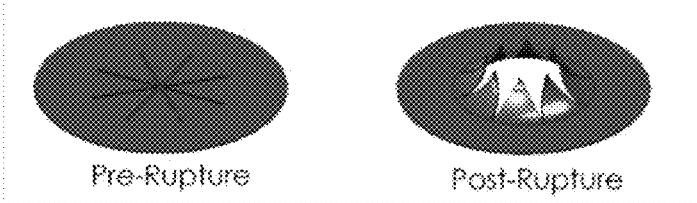
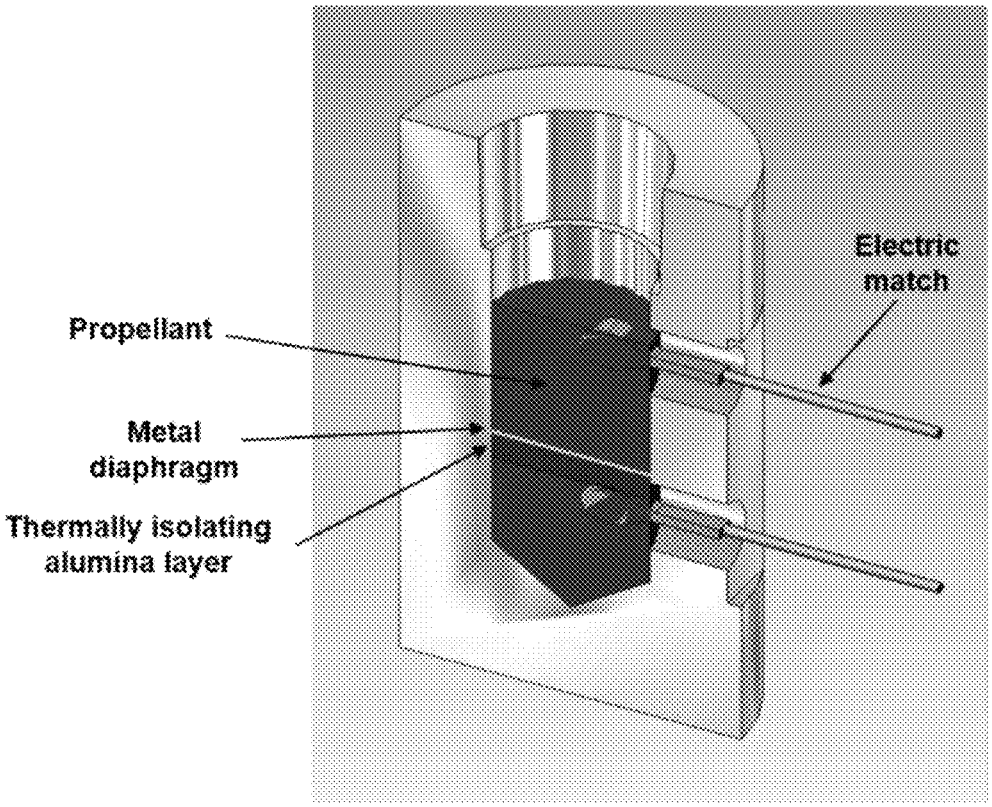
FIG. 5 (PRIOR ART)

CONTROLLED PAYLOAD RELEASE MECHANISM FOR MULTIPLE STACKS OF PYROPHORIC FOILS TO BE CONTAINED IN A SINGLE DECOY DEVICE CARTRIDGE

CROSS-REFERENCE TO RELATED APPLICATION

This application claims the benefit of earlier U.S. Provisional Application No. 62/668,193, filed on May 7, 2018, the entire contents thereof being incorporated herein by reference.

The present application is related to U.S. Pat. Nos. 9,702,670; 9,151,581; 7,975,468; 7,973,270; 7,973,269 and 7,800,031, the entire contents of each of which is incorporated herein by reference.

BACKGROUND

1. Field

The present invention relates generally to decoy devices and more particularly to a controlled payload release mechanism for multiple stacks of pyrophoric foils to be contained in a single decoy device cartridge.

2. Prior Art

Pyrophoric decoys are part of a family of advanced Infrared (IR) decoys designed for use by Department of the Navy fixed-wing and rotary-wing aircraft to successfully decoy advanced-threat missile systems in current and future operational environments. Pyrophoric decoys utilize a special, high surface area metal foil, which rapidly oxidizes when exposed to oxygen. When dispensed from the host aircraft, the special pyrophoric alloy material payload reacts with air to emit intense IR radiation that is not visible to the naked eye. The IR radiation diverts or decoys IR-seeking missiles away from the host aircraft. The current pyrophoric decoy is composed of pyrophoric iron coated onto steel foil. Several hundred pyrophoric foils comprise the payload of a typical decoy and are currently dispensed simultaneously from an airtight casing via the action of a single impulse cartridge which incorporates Hazard from Electromagnetic Radiation to Ordnance (HERO) Safe features. Pyrophoric metals are shaped like thin wafers and basically rusts so quickly that it gives off a heat signature which is in the sensing spectrum of the missile's heat-seeking sensor.

An example of a decoy flare device that utilizes the pyrophoric material and is currently used in many Naval aircrafts is shown in FIG. 1. The special material is encased within a one-piece cylindrical aluminum case with dimensions approximately 5.8" (L)×1.4" (D) and weighs roughly 0.8 lbs. Additional components that are featured in the decoy device is an impulse cartridge, a piston, and an end cap. The physical characteristics and the main components of the decoy device is shown in FIG. 2, including the piston, pyrophoric payload, end cap, and one-piece cylindrical aluminum casing of the decoy device.

The impulse cartridge is initiated by a provided electrical pulse to initiate the ejection of the countermeasure flare. After a firing signal is sent to the impulse cartridge through an aircraft's on-board deployment system, the expansion of generated gases forces the piston forward, causing the end cap to rupture, and eject the pyrophoric material. The ejected pyrophoric payload is then exposed to the atmosphere, resulting in intense emission of IR radiation to function as a decoy for heat seeking missile.

Another example of an infrared countermeasure decoy launched from a multiple flare magazine installed on a dispenser to decoy IR heat-seeking missiles is shown in FIGS. 3 and 4. The decoy flare is contained within a 1"×1"×8" aluminum one-piece case. The base end of the case has a receptacle with an O-ring for the impulse cartridge and a plastic piston. The opposite end is closed with a plastic end cap sealed with an O-ring. The pyrophoric metal is located between the piston and the plastic end cap. Such decoy devices require an impulse cartridge for functioning. For use, an impulse cartridge is inserted into the receptacle in the base of the flare. When the impulse cartridge is initiated by the firing pulse, the impulse cartridge receptacle cup's frangible membrane ruptures. Pressure inside the canister increases and acts on the piston, breaking the plastic end cap seal and deploying the pyrophoric metal payload into the airstream. This results in the pyrophoric metal reacting with the air to emit IR energy.

Multi-stage thrusters of nozzle and slug types have been developed to reduce the required actuation power and size of related components for terminal guidance actuation of smart and guided munitions; increasing the number of actuation pulses available in thruster type actuators; and reducing the actuation pulse duration for control actuation of high-spin rounds. In such nozzle type thruster, several layers of propellants are packaged in a single thruster and separated by protective layers to avoid sympathetic ignition and to allow the individual shots to be ignited electrically at any desired time.

The multi-stage thrusters of nozzle and slug type use several layers of propellants packaged in a single thruster and separated by protective layers to avoid sympathetic ignition and allow the individual shots to be ignited at any desired time. In these thrusters, adjacent stages are separated by a layer of compacted alumina powder.

In the case of a nozzle discharge type thruster, each alumina layer is capped by a scored metal diaphragm to protect the alumina layer from dispersion following ignition of the propellant that is covering it. A two-stage thruster is shown in FIG. 5. The two-stage thruster of FIG. 5 is electrically initiated with the scored metal diaphragm its pre-rupture, FIG. 6*a* and post-rupture FIG. 6*b* configurations. The diaphragm caps the alumina layer to protect it from dispersion upon ignition of the overlaying propellant.

SUMMARY

There is a need in the art for a pyrophoric payload release mechanism that can either bind or contain multiple (2 or more) discrete sub-payloads of pyrophoric foils upon dispense from a device and then release the material in a controlled, timed manner such that multiple discrete bursts of infrared energy are produced from the dispense of a single cartridge. The mechanism does not have to be susceptible to HERO within the sealed aluminum cartridge; can make efficient use of volume as the total volume available for payload of approximately 5 inches in length by approximately 1.3 inches in diameter; can utilize the force and/or flame from conventional impulse cartridges to initiate the dispense/release sequence; can function reliably after significant shock from the impulse cartridge; can provide consistent and controllable timed release of the pyrophoric material payload, and can be variable to optimize the timing of the release of the individual stacks of pyrophoric material.

Accordingly, a controlled (timed) payload release mechanism for multiple stacks of pyrophoric foils to be contained in a single decoy device cartridge are provided. In the multi-stack pyrophoric foil decoy cartridge, such objective can be achieved by implementing technologies for multi-stage thrusters of nozzle and slug types (see below). In this technology, several layers of propellants are packaged in a single thruster and separated by protective layers to avoid sympathetic ignition and to allow the individual shots to be ignited electrically at any desired time. The adjacent stages are separated by a layer of compacted alumina powder. In nozzle discharge type thrusters, the alumina layer is capped by a scored metal diaphragm to protect the alumina layer from dispersion following ignition of the propellant covering it. Such technology is well suited for application of the controlled (timed) payload release mechanism for multiple stacks of pyrophoric foils to be contained in a single decoy device cartridge.

Three basic decoy configurations are disclosed herein. All three concepts are based on the multi-stage thruster technology and can accommodate multiple stacks of pyrophoric foils for arbitrarily timed ejection from each decoy device cartridge. In these configurations, pyrophoric foil stacks are ejected by provided driving pistons that are forced out of the decoy cartridge either by electrically initiated impulse cartridges or propellants consolidated under the driving pistons to minimize the required volume. Each impulse cartridge or propellant layer can be isolated from the next stack of pyrophoric foils by a layer of alumina, which can be capped by a scorched metal diaphragm to prevent sympathetic ignition. The metal diaphragms can also serve to fully enclose each pyrophoric foil stack assembly in a metal (Faraday) cage, thereby providing each and every pyrophoric foil stack assembly with a Hazard from Electromagnetic Radiation to Ordnance (HERO) safe design.

In addition, also provided is a modification of one of the configurations in which all pyrophoric foil stack assemblies are dispensed simultaneously from the decoy device cartridge and would subsequently release their pyrophoric materials in a controlled timely fashion as the collection of pyrophoric foil stack assemblies freefall in the airstream.

The multi-stage flare with patterned gas dispersion nozzle is disclosed in U.S. Pat. No. 9,702,670, the entire contents of which is incorporated herein by reference.

The decoy cartridges with multiple stacks of pyrophoric foils disclosed herein, include one or more of the following features:

1. All configurations can have the same form, fit, and function as existing decoy cartridge cases and can be capable of being dispensed from existing airborne countermeasure dispenser systems.

2. The proposed configurations can use a proven technology for multi-stage thrusters.

3. The multi-stack pyrophoric foil decoy cartridge configurations can accommodate three or more stacks that can be dispensed sequentially via electrical commands from existing airborne countermeasure dispenser system.

4. The pyrophoric foil stacks can be separated by compacted alumina layers that are capped by a thin scored metal diaphragm to prevent sympathetic ignition.

5. In one configuration, electrically initiated impulse cartridges can be used to eject each pyrophoric foil stack via provided sealed piston elements.

6. In another configuration, electrically initiated propellants charges (e.g., consolidated 'Bullseye' smokeless propellant or the like) can be integrated with the sealed ejection piston of each pyrophoric foil stack. Such configuration can provide the means of significantly reducing the volume that would otherwise be occupied with the use of impulse cartridges and thereby maximize the total volume available for pyrophoric foils.

7. In another configuration, dispensation of the first pyrophoric foil stack of a decoy cartridge ignites a delay fuse, which would sequentially dispense the following pyrophoric foil stack of the decoy cartridge, each with a set time delay. Such configuration can employ a simpler design and only require a single dispensation command.

In the multi-stack pyrophoric foil decoy cartridge, each individual stack can be held within fully metallic bounds (e.g., a Faraday cage) up to the moment of ejection from the decoy cartridge. As a result, the decoy cartridge and its multi-stack pyrophoric foil stages can be immune to electromagnetic radiation. Therefore, the multi-stack pyrophoric foil decoy cartridge can be designed to satisfy strictest Hazard from Electromagnetic Radiation to Ordnance (HERO) requirements. In addition, the electrical initiation command signals can be routed through optical power and data links to achieve even higher EMI and EMP immunity.

BRIEF DESCRIPTION OF THE DRAWINGS

These and other features, aspects, and advantages of the apparatus of the present invention will become better understood with regard to the following description, appended claims, and accompanying drawings where:

FIG. 5 illustrates a two-stage nozzle discharge thruster.

FIG. 6*a* illustrates a pre-ruptured scored metal diaphragm used in the thruster of FIG. 5.

FIG. 6*b* illustrates the scored metal diaphragm of FIG. 5*a* being ruptured.

DETAILED DESCRIPTION

In the embodiments disclosed herein, and for the sake of illustration clarity, the decoys are shown with only pyrophoric foil stack assemblies. However, it will be appreciated by those having ordinary skill in the art that more stack assemblies may also be provided, however, at the cost of reducing the total payload volume.

In a conventional decoy device, a one-piece cylindrical aluminum case is fitted with one single impulse cartridge to function as a power source for the ejection of countermeasure flares. When the impulse cartridge receives an electrical firing pulse from the aircraft, the build-up of expanding gases from the chemical reaction with the energetic materials forces a piston to move rapidly forward, causing the cartridge end-cap to rupture and release the stacked pyrophoric foil layers into the airstream. Such underlying concept is applied here, but with at least one additional impulse cartridge implemented and separated into discrete sub-payloads using a metal diaphragm and an alumina granules barrier layer as shown in FIG. 7*a*.

Figure 1:
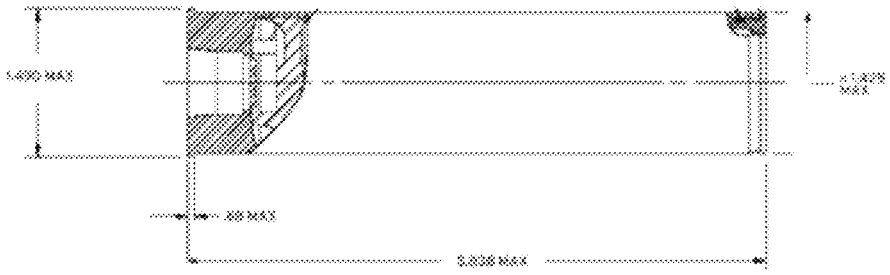
FIG. 1 (PRIOR ART)
FIG. 1 illustrates a decoy device showing the maximum allowable dimensions of the system.
Figure 2:
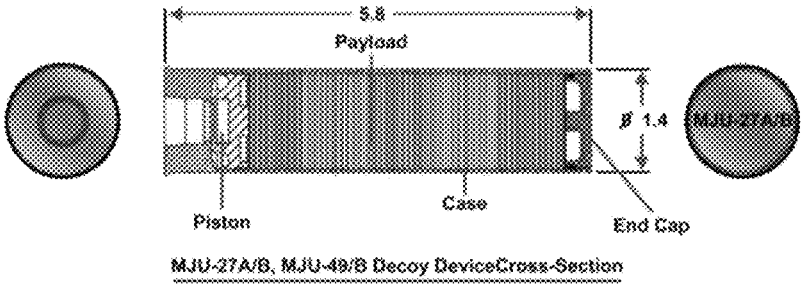
FIG. 2 (PRIOR ART)
FIG. 2 illustrates the physical characteristics of another decoy device.
Figure 3:
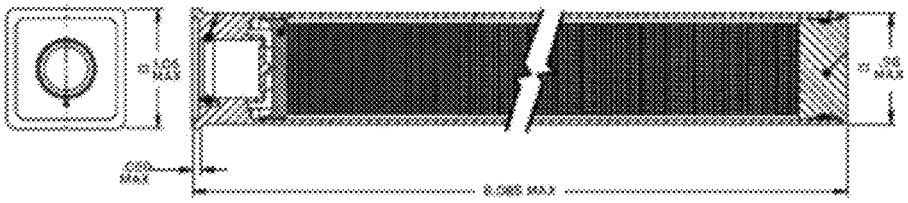
FIG. 3 (PRIOR ART)
FIG. 3 illustrates maximum dimensions of a rectangular flare casing.
Figure 4:
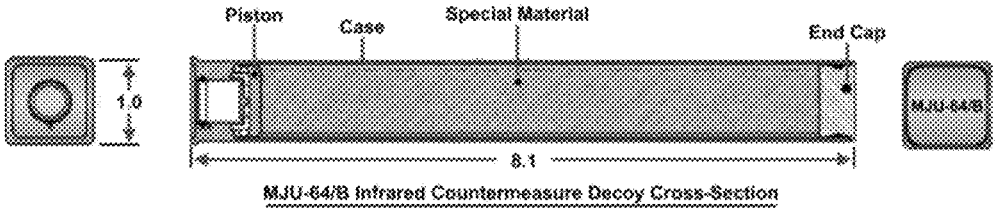
FIG. 4 (PRIOR ART)
FIG. 4 illustrates main components of an infrared countermeasure decoy flare.
Figure 7A:
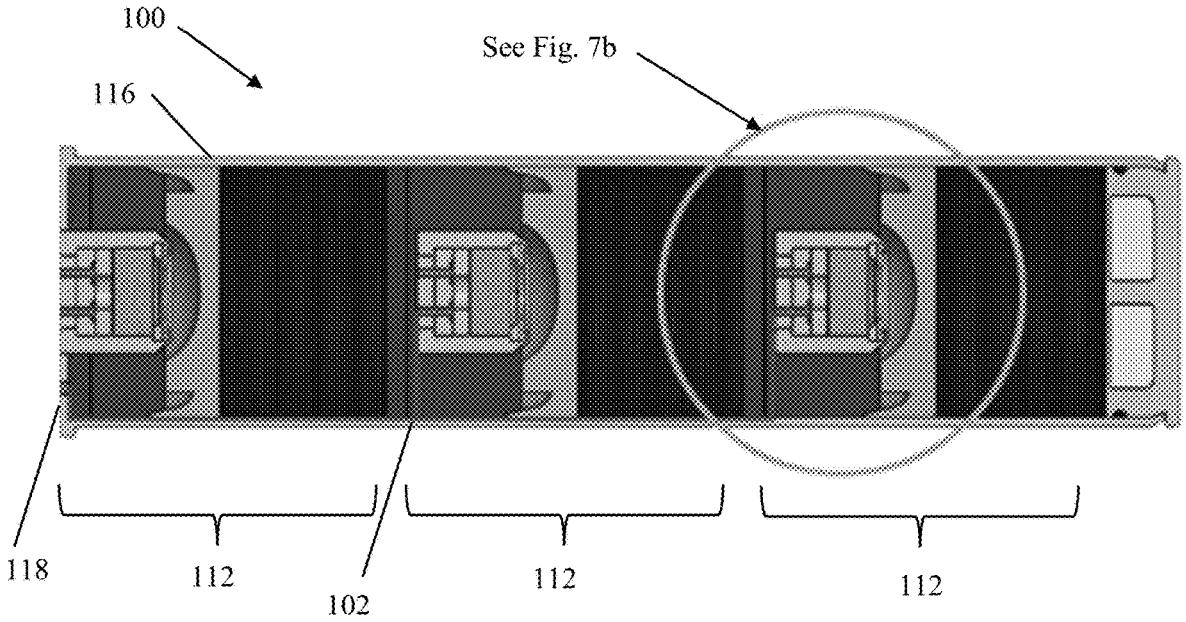
FIG. 7*a* illustrates a cross-sectional view of a multi-stack pyrophoric foil decoy cartridge.
Figure 7B:
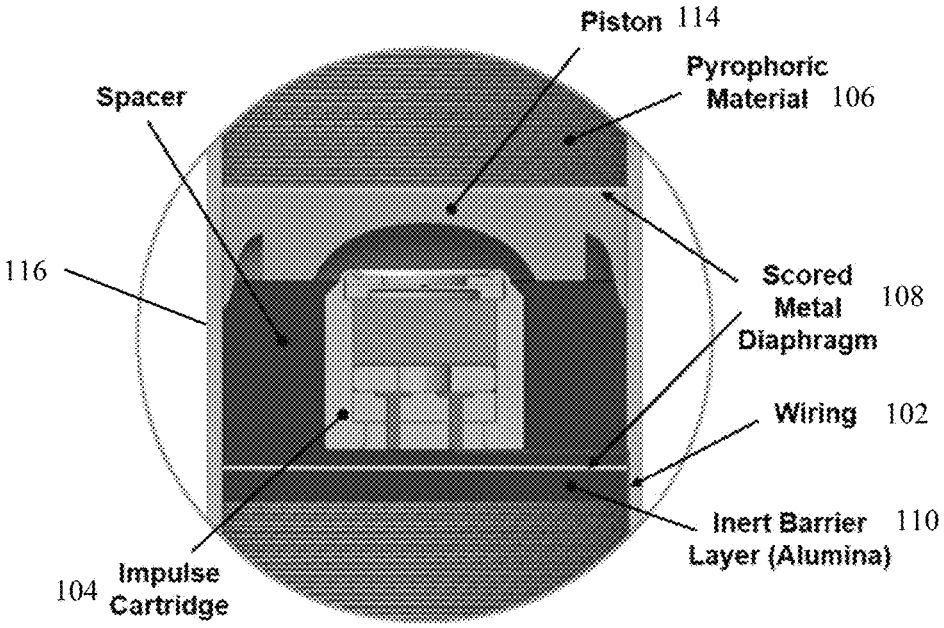
FIG. 7*b* illustrates a foil stack from the detail in FIG. 7*a*.

In the decoy device 100 of FIG. 7*a*, a series of wires 102 connect each impulse cartridge 104 to tabs featured on the decoy cartridge base as in the current decoys for connection to the Countermeasure Dispensing System. The decoy deployment system will then be able to control the sequential ejection of pyrophoric foil stack assemblies 106 in an as-needed manner. Initiation of an impulse cartridge 104 forces the corresponding piston 114 to eject a forward corresponding pyrophoric foil stack assemblies 106 from the cartridge body 116. As shown in FIG. 7*b*, the presence of both a pre-scored diaphragm 108 and an inert barrier layer 110 compromising, for example, consolidated alumina granules, allows for the remaining sub-payloads 112 to stay in position and prevents sympathetic burning after ejection of each pyrophoric foil stack assembly 106.

It is noted that the scored metallic diaphragms 108 serve two purposes. Firstly, they are intended to prevent dispersion of the underlying compacted alumina that is provided to prevent sympathetic ignition, and secondly, for the purpose of forming a Faraday cage for each pyrophoric foil stack assembly to keep them immune from electromagnetic waves (EMI and EMP), as required for Hazard from Electromagnetic Radiation to Ordnance (HERO) safety.

As can be seen in the blow-up view of FIG. 7*b*, each pyrophoric foil stack 106 is provided with an alumina thermal barrier layer 110, metal diaphragms 108, an impulse cartridge 104, and a piston 114 for ejecting the pyrophoric foil stack 106 upon impulse cartridge initiation. The provided wiring 102 connects each impulse cartridge 104 to an appropriate tab on the decoy cartridge base 118 for contact with the mating tabs of the Countermeasure Dispensing System.

Figure 8A:
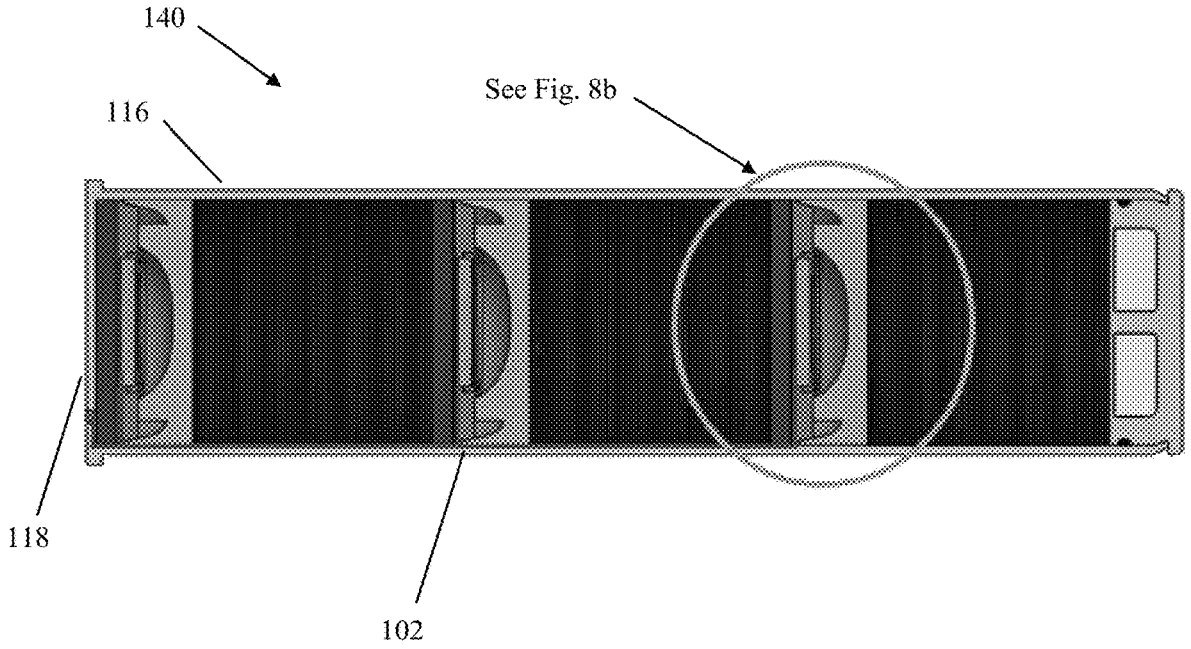
FIG. 8*a* illustrates a cross-sectional view of another embodiment of a multi-stack pyrophoric foil decoy cartridge.

In another embodiment 140, and to increase the available pyrophoric foil stack (payload) volume for each stack assembly, the impulse cartridges 104 of the concept of FIGS. 7*a* and 7*b* are replaced by piston integrated ejection charges, which are intended to be similarly ignited by electric matches as shown in FIG. 8*a*. The significant amount of increase in the volume of the pyrophoric foil stacks should significantly increase the effectiveness of the decoy system by emitting the intense IR spectrum over a larger volume of space.

Figure 8B:
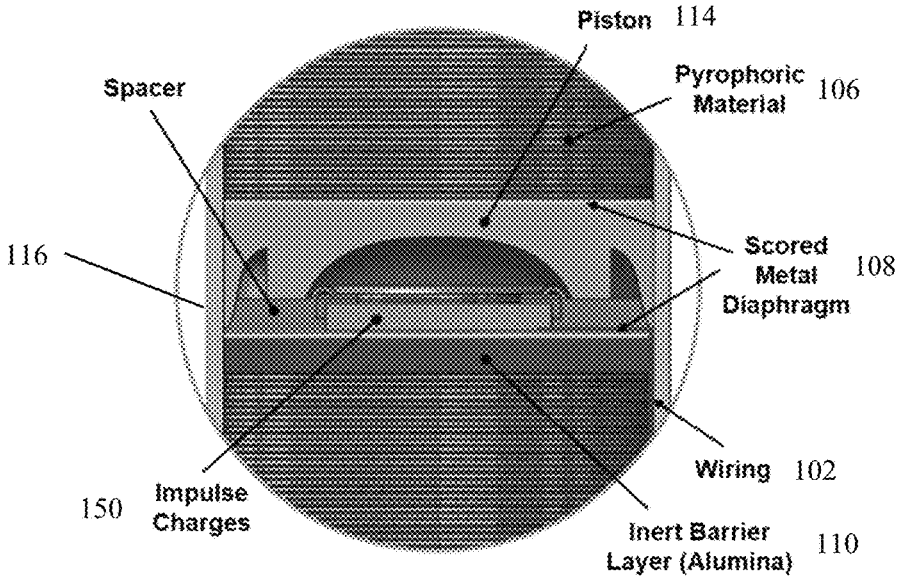
FIG. 8*b* illustrates a foil stack from the detail in FIG. 8*a*.

As can be seen in FIG. 8*a* and its blow-out view of FIG. 8*b*, each discrete pyrophoric foil stack 106 is provided with energetic materials (ejection or impulse charges) 150 that are confined within a crimped housing cartridge situated in the concavity of a piston 114. Similar to the concept of FIGS. 7*a* and 7*b*, the ejection charges 150 are initiated electrically by the powering of the provided electric matches for sequential ejection of pyrophoric foil stack assemblies 106 in an as-needed manner.

A cross-sectional view of the second embodiment with ejection charge integrated pistons is provided in FIG. 8*a*. As can be seen in the blow-up view of FIG. 8*b*, the energetic material (ejection charge) 150 is contained within a crimped housing cartridge underneath the piston 114. Each pyrophoric foil stack assembly is provided with inert (alumina) layer 110, diaphragms 108, a piston 114 with integrated ejection charge assembly 150, pyrophoric foil stack 106 (payload), and the necessary wiring 102 that connects each ejection charge electric match to an appropriate tab on the decoy cartridge base 118 for contact with the mating tabs of the countermeasure dispensing system.

Figure 9:
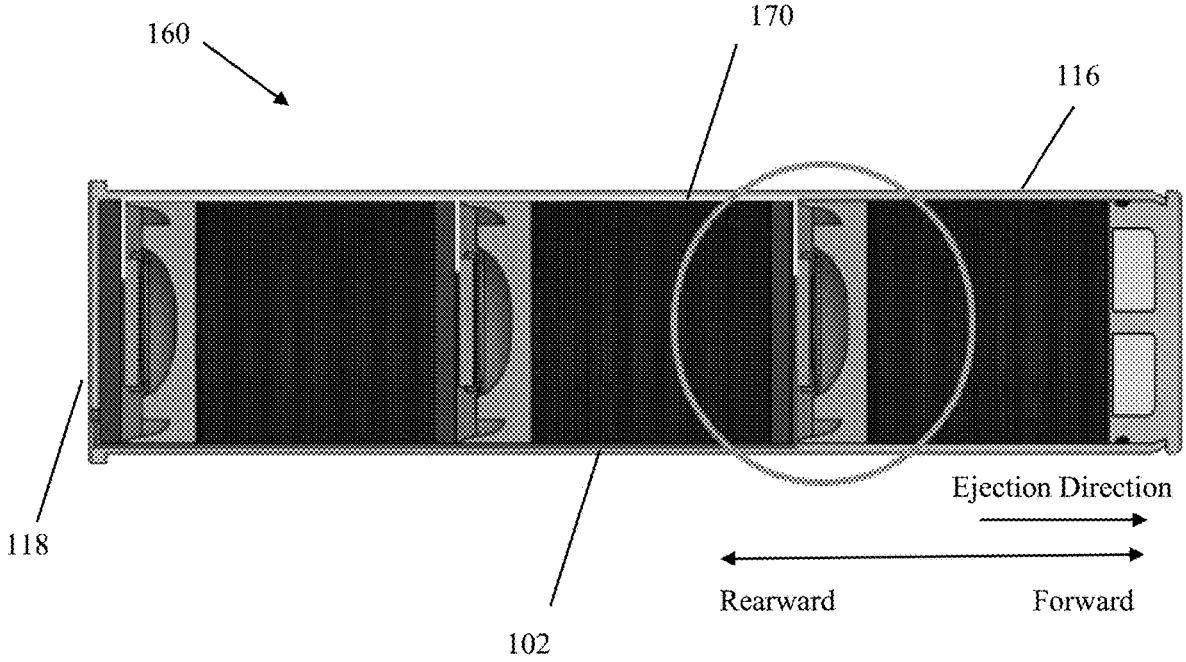
FIG. 9 illustrates a modification of the multi-stack pyrophoric foil decoy cartridge of FIG. 8*a*.

A modification of the multi-stack pyrophoric foil decoy cartridge 140 of FIGS. 8*a* and 8*b*, is shown in FIG. 9 and generally referred to by reference number 160. In this modification, the first (forward in a direction of ejection) pyrophoric foil stack 106 assembly is ejected as was described for the concept of FIGS. 7*a* and 7*b*. However, the ejection charges of the subsequent (rearward) pyrophoric foil stack 106 assemblies are sequentially initiated by the provided time-delay fuse strips 170. In this modification, the ejection (impulse) charges of the first (forward) pyrophoric foil stack 106 assembly is designed to also ignite the time-delay fuse strip, which would then sequentially ignite ejection charges of the remaining pyrophoric foil stack 106 assemblies. It is appreciated that such time-delay fuse strips can be designed to burn at rates that are in millisecond per inch to those that are in tens of seconds per inch. This modification has the advantage of being simpler in design and only requires a single dispensation command.

It is also noted that a similar modification can be made to the multi-stack pyrophoric foil decoy cartridge concept of FIGS. 7*a* and 7*b*, however, additional pyrotechnic charges may be provided so that the flame from the first impulse cartridge could ignite the fuse strip.

In addition to the above embodiments, the following modifications may also be made. In these modifications, all pyrophoric foil stack assemblies are dispensed simultaneously by a single impulse cartridge or piston integrated charge from the decoy device cartridge and would subsequently release their pyrophoric materials in a controlled timely fashion as the collection of pyrophoric foil stack assemblies freefall in the airstream.

The modifications may require:

Each pyrophoric foil stack assembly to be protected in a separate sealed compartment;

The added packaging requirement may reduce the available volume of pyrophoric foil stacks (payload);

Unless a time-delay fuse is employed, each pyrophoric foil stack assembly may be provided with a separate means of ignition such as an electrical energy source (capacitor or battery) and if the timing must be programmable, there may be a need for appropriate onboard circuitry and electronics; and Due to the free-fall nature of the released pyrophoric foil stack assemblies, the available range of time between the pyrophoric foil stack releases may be limited.

Although the embodiments discussed above are particularly well suited to multi-stack pyrophoric foil decoy cartridges for military aircraft, they can also be applied to countermeasure flares used in commercial non-military applications. Although, countermeasure flares have previously been used in only military applications for defensive countermeasures, the same now have widespread application in commercial applications for signaling and illumination. However, as the world grows more dangerous, more commercial companies are relying on countermeasure flares for defensive countermeasure to protect their assets, such as airline and cruise ship vessels.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A decoy device comprising:

a cartridge casing; and two or more pyrophoric assemblies disposed longitudinally in the casing for sequential ejection from the casing, the two or more pyrophoric assemblies comprising:

a pyrophoric material;

a piston positioned rearward in an ejection direction relative to the pyrophoric material, the piston being movable in the ejection direction upon application of ejection force to eject the pyrophoric material from the casing;

one or more energetic materials positioned rearward in an ejection direction relative to the piston, the one or more energetic materials being initiated by electrical impulse to provide the ejection force to the piston; and an inert barrier layer positioned rearward in an ejection direction relative to the one or more energetic materials.

2. The decoy device of claim 1, further comprising a first scored diaphragm positioned between the piston and the pyrophoric material.

3. The decoy device of claim 2, further comprising a second scored diaphragm positioned between the one or more energetic materials and the inert barrier layer.

4. The decoy device of claim 1, wherein the inert barrier layer is alumina.

5. The decoy device of claim 1, further comprising wiring extending from a base of the casing to the energetic material of at least a forward most one of the two or more pyrophoric assemblies to electrically initiate the energetic material of at least the forward most one of the two or more pyrophoric assemblies.

6. The decoy device of claim 5, wherein the wiring extends from the base to the energetic material of each of the two or more pyrophoric assemblies to sequentially electrically initiate the energetic material of each of the two or more pyrophoric assemblies.

7. The decoy device of claim 5, further comprising a fuze operatively connected to the energetic material of each of the other of the two or more pyrophoric assemblies, the fuze being initiated by the electrical initiation of the energetic material of at least the forward most one of the two or more pyrophoric assemblies.

8. The decoy device of claim 1, wherein the energetic material is integrated into the piston.

9. The decoy device of claim 1, wherein the energetic material is an impulse cartridge arranged between the piston and the inert barrier layer.

* * * * *